US005365417A

United States Patent [19]

Chen

[11] Patent Number: 5,365,417

[45] Date of Patent: Nov. 15, 1994

[54] COMPLEMENTARILY AGGREGATED LIGHTING FIXTURE AND RACK APPARATUS

[76] Inventor: Duncan Chen, P.O. Box 55-1670, Taipei (104), Taiwan, Prov. of China

[21] Appl. No.: 209,456

[22] Filed: Mar. 14, 1994

[51] Int. Cl.[5] ..... F21V 33/00

[52] U.S. Cl. ..... 362/154; 362/253; 362/294; 362/414; 312/223.5

[58] Field of Search ..... 312/223.5; 362/125, 362/126, 132, 154, 294, 253, 410, 414

[56] References Cited

U.S. PATENT DOCUMENTS 1,691,137 11/1928 Schuchert ..... 362/132

4,939,625 7/1990 Olson ..... 362/253 X

*Primary Examiner*—Stephen F. Husar

[57] ABSTRACT

A combination of lighting fixture and rack includes: a lamp installed on a top portion of a rack having a plurality of ribs juxtapositionally disposed on a right and a left side portion of a central column of the rack for inserting a plurality of compact disks (CDs) or cassette tapes on the ribs of the rack, and a lamp shade mounted on the lamp, whereby upon powering of the lamp to create a thermosyphon for drafting air streams around the lamp for ventilating the disks or tapes held on the rack for preventing mildew of the disks and tapes for hygienic purpose besides an illumination purpose of the lamp.

4 Claims, 3 Drawing Sheets

COMPLEMENTARILY AGGREGATED LIGHTING FIXTURE AND RACK APPARATUS

BACKGROUND OF THE INVENTION

For storing a plurality of musical cassette tapes or compact disks (CD), a cabinet having many small closed drawers may be provided for respectively storing the compact disks or tapes in the drawers. However, the compact disks or tapes held in the closed drawers, if not well ventilated, may be easily mildewed to influence their quality and to cause hazard for human health. Meanwhile, a lamp should be further provided for illumination purpose whenever selecting or handling the compact disks or tapes in the cabinet, causing inconvenience for implementing the lamp and cabinet equipments.

SUMMARY OF THE INVENTION

The object of the present invention is to provide a combination of lighting fixture and rack including: a lamp installed on a top portion of a rack having a plurality of ribs juxtapositionally disposed on a right and a left side portion of a central column of the rack for inserting a plurality of compact disks (CDs) or cassette tapes on the ribs of the rack, and a lamp shade mounted on the lamp, whereby upon powering of the lamp to create a thermosyphon for drafting air streams around the lamp for ventilating the disks or tapes held on the rack for preventing mildew of the disks and tapes for hygienic purpose besides an illumination purpose of the lamp.

DETAILED DESCRIPTION

Figure 1:
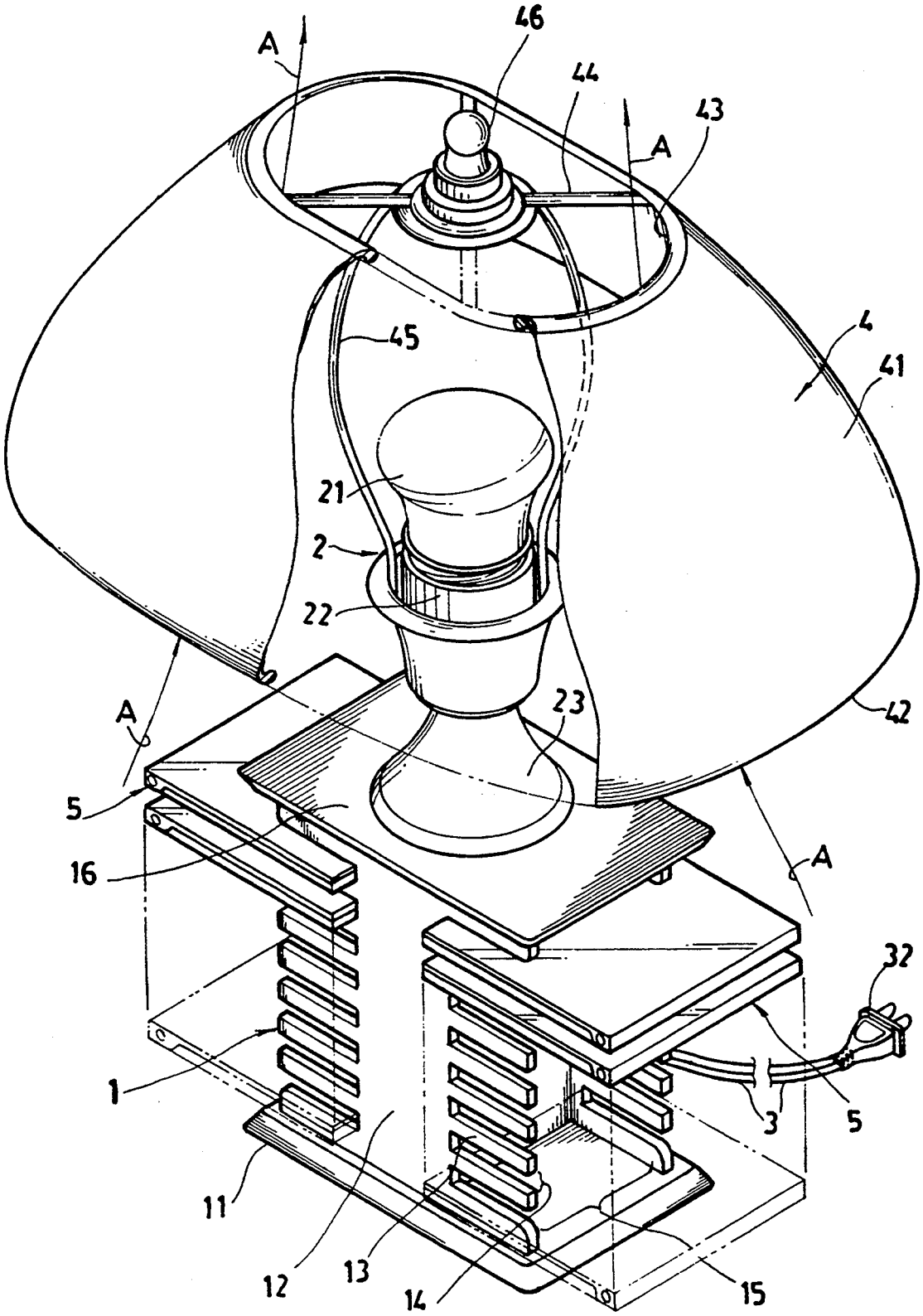
FIG. 1 is a perspective view of the present invention.
Figure 2:
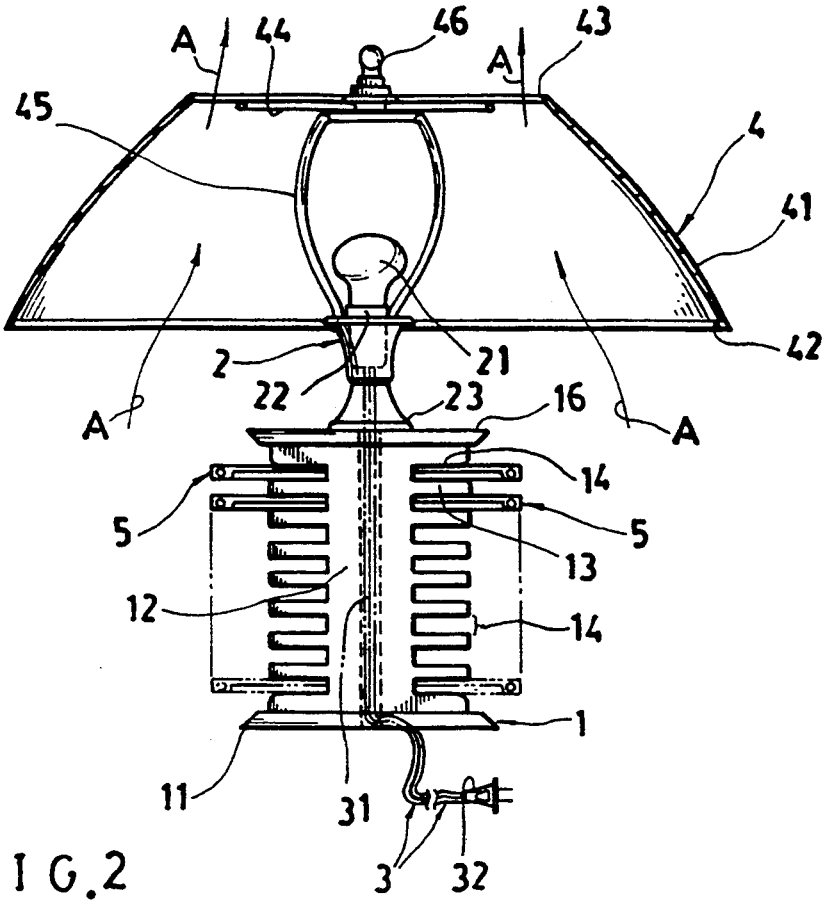
FIG. 2 is a front view of the present invention.
Figure 3:
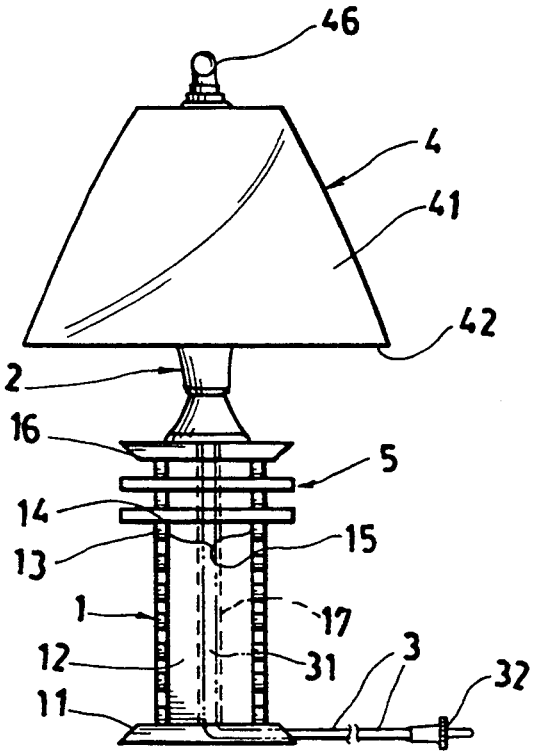
FIG. 3 is a side view of the present invention.
Figure 4:
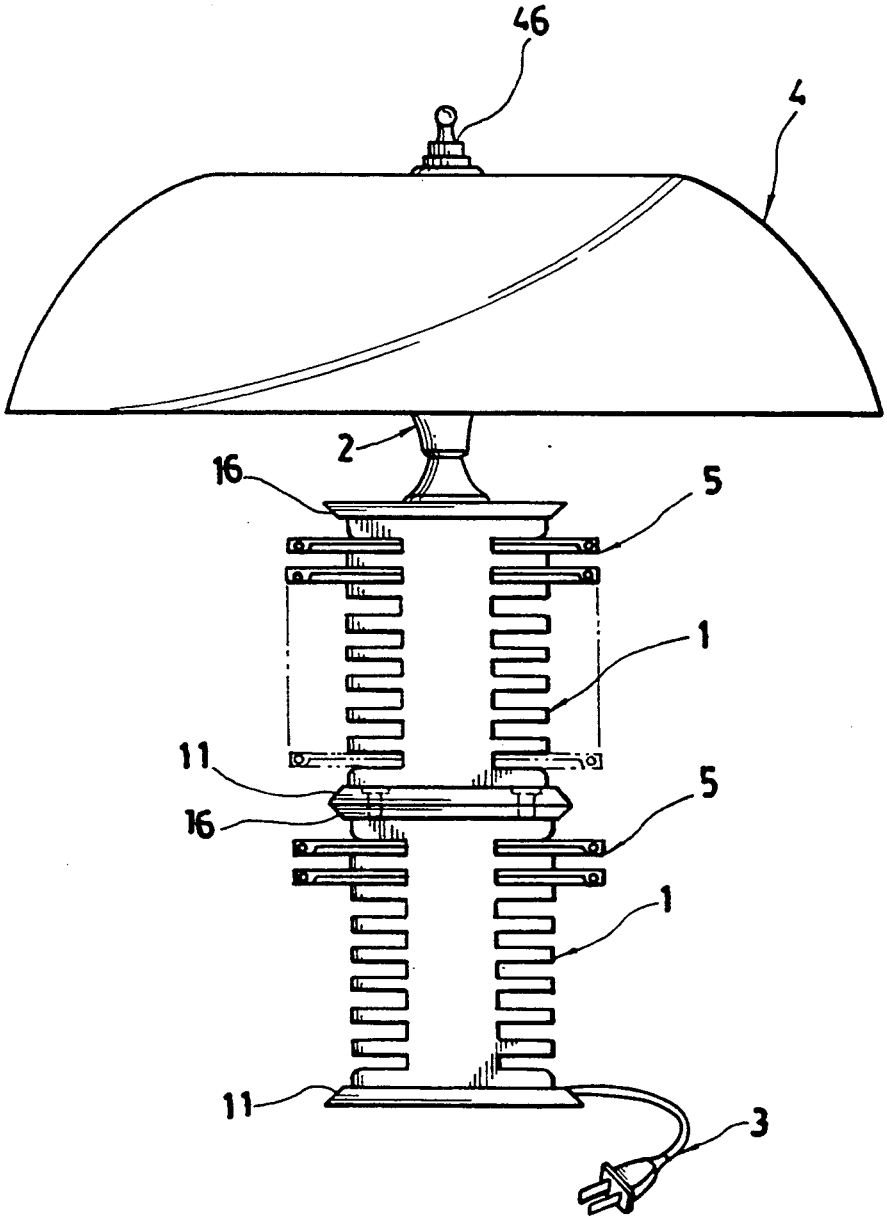
FIG. 4 shows another preferred embodiment of the present invention when piled with two rack means.

As shown in FIGS. 1–3, the present invention comprises: a rack means 1, an illuminating means 2, a power supply means 3, and a lamp shade means 4, with a plurality of disk shaped articles 5 stored or held on the rack means 1. The disk shaped articles 5 may be referred to compact disks (CD), cassette tapes or any other articles suitably inserted or held on the rack means 1. Plural rack means 1 can be overlapped or piled to increase the height such as shown in FIG. 4.

The rack means 1 includes: a base 11 laid on a table or floor surface, a central column 12 protruding upwardly from the base 11, a plurality of pairs of ribs 13 juxtapositionally disposed on a right side portion and a left side portion of the central column 12 with each pair of ribs 13 protruding sidewardly from the central column 12 and parallelly oriented on the central column 12 for holding each disk shaped article 5 on the pair of ribs 13, an upper plate 16 secured on a top portion of the central column 12 for mounting the illuminating means 2 on the upper plate 16, and a central through hole 17 formed in a central portion of the upper plate 16 and through the central column 12 for inserting an electrical cord 31 of the power supply means 3 in the central through hole 17 for directing power from a power source through a plug 32 which may be connected to a receptacle (not shown) such as mounted on an inside wall of a room to the illuminating means 2.

The power supply means 3 may include a main switch (not shown) provided on the illuminating means 2 or on other suitable locations for on-off control of the power from the power source.

The illuminating means 2 includes: an illuminator 21 such as a bulb held in a socket 22 which is secured in a connector 23 mounted on an upper portion of the upper plate 16. The electrical cord 31 has an output terminal formed on an upper end portion of the cord 31 for connecting the socket 22 for electrically powering the illuminator 21 when inserted in the socket 22.

Each pair of ribs 13 defines a longitudinal spacing 15 between two ribs 13 protruding sidewardly from and parallelly oriented on the central column 12 of the rack means 1 for providing an enough air passage for air ventilation purpose when an air stream A is drafted upwardly as shown in FIGS. 2 and 1 when lighting an illuminator 21 of the illuminating means 2 as powered by the power supply means 3, and every pair of ribs 13 is separated from another neighbouring pair of ribs 13 with a latitudinal slot 14 transversely recessed in a right side portion and a left side portion of the central column 12 for inserting each disk shaped article 5 in each latitudinal slot 14 is between every two neighbouring pairs of ribs 13.

The lamp shade means 4 includes: a shade 41 generally truncated-cone shaped and tapered upwardly, a bottom opening 42 formed in a bottom portion of the shade 41, a top opening 43 formed in a top portion of the shade 41 and having an upper opening area of the top opening 43 smaller than a lower opening area of the bottom opening 42, a bracket 44 formed on a top portion of the shade 41 and secured on a top portion of a supporting link 45 protruding upwardly from the illuminating means 2 by a nut 46. Naturally, the shade may also be modified to be an inverted cone shape to have a larger top opening and a smaller lower opening such as used in an uplit floor lamp.

When the illuminator 21 of the illuminating means 2 is powered by the power supply means 3, the lighting of the illuminator 21 will create an illumination function and also create a thermosyphon effect around the illuminator 21 and the rack means 1 to forceably draft air streams A upwardly for well ventilating the disk shaped articles 5 stored on the ribs 13 of the rack means 1 for preventing growing of fungi and bacteria on the disk shaped articles 5 and preventing mildew of the articles 5 for hygienic purpose and for keeping a well quality of the articles 5. Since the illuminator 21 is formed in situ above the rack means 1, a well illumination may also be effected for a clear observing of the articles 5 in selecting, handling and storing the articles 5.

Therefore, the present invention provides a synergetic aggregation of a lighting fixture and a rack device for convenient, hygienic and illuminative multiple uses.

The bottom opening 42 of the shade 4 should have an area larger than an area of a projective top view of the rack means 1 for well ventilation due to thermosyphon.

The present invention may be modified and changed without departing from the spirit and scope of this invention. The illuminator 21 may be a single lamp or plural lamps, not limited in this invention.

The rack means 1 provided with the lamp or illuminator 21 thereon can be fixed on a wall by bolts and mounting plate (not shown) to serve a wall lamp.

I claim:

1. A lighting fixture and rack apparatus comprising:

a rack means (1) for holding and storing a pluraliy of disk shaped articles (5) thereon;

an illuminating means (2) having at least an illuminator (21) inserted in a socket (22) secured in a connector (23) mounted on an upper portion of the rack means (1);

a power supply means (3) having an electrical cord (31) inserted in a central portion of said rack means (1) for directing a power from a power source to the illuminator (21) for powering and lighting said illuminator (21); and a lamp shade means (4) mounted on a top portion of said illuminating means (2), whereby upon powering of said illuminator (21), a thermosyphon is formed around said illuminator (21) and said rack means (1) for drafting air streams around said rack means (1), said illuminating means (2) and in said lamp shade means (4) for well ventilation of said disk shaped articles (5) held on said rack means (1).

2. A lighting fixture and rack apparatus according to claim 1, wherein said rack means (1) includes: a base (11), a central column (12) protruding upwardly from the base (11), a plurality of pairs of ribs (13) juxtapositionally disposed on a right side portion and a left side portion of the central column (12) with each pair of ribs (13) protruding sidewardly from the central column (12) and parallelly oriented on the central column (12) for holding each disk shaped article (5) on the pair of ribs (13), an upper plate (16) secured on a top portion of the central column (12) for mounting the illuminating means (2) on the upper plate (16), and a central through hole (17) formed in a central portion of the upper plate (16) and through the central column (12) for inserting said electrical cord (31) of the power supply means (3) in the central through hole (17) for directing power from a power source through a plug (32) connected to a receptacle.

3. A lighting fixture and rack apparatus according to claim 2, wherein each said pair of ribs (13) defines a longitudinal spacing (15) between every two ribs (13) protruding sidewardly from and parallelly oriented on the central column (12) of the rack means (1) for providing an enough air passage for air ventilation purpose when an air stream (A) is drafted upwardly when lighting an illuminator (21) of the illuminating means (2) as powered by the power supply means (3), and every pair of ribs (13) is separated from another neighbouring pair of ribs (13) with a latitudinal slot (14) transversely recessed in a right side portion and a left side portion of the central column (12) for inserting each disk shaped article (5) in each latitudinal slot (14) is between every two neighbouring pairs of ribs (13).

4. A lighting fixture and rack apparatus according to claim 1, wherein said lamp shade means (4) includes: a shade (41) generally truncated-cone shaped and tapered upwardly, a bottom opening (42) formed in a bottom portion of the shade (41), a top opening (43) formed in a top portion of the shade (41) and having an upper opening area of the top opening (43) smaller than a lower opening area of the bottom opening (42), a bracket (44) formed on a top portion of the shade (41) and secured on a top portion of a supporting link (45) protruding upwardly from the illuminating means (2) by a nut (46), with said bottom opening (42) having an area larger than an area from a projective top view of the rack means (1).

* * * * *